United States Patent [19]

Bullivant

[11] Patent Number: 4,548,526

[45] Date of Patent: Oct. 22, 1985

[54] PILING METHOD

[75] Inventor: Roger A. Bullivant, Burton-on-Trent, England

[73] Assignee: Roger Bullivant Inc., Grand Prairie, Tex.

[21] Appl. No.: 472,832

[22] Filed: Mar. 7, 1983

[30] Foreign Application Priority Data

Mar. 6, 1982 [GB] United Kingdom ..... 8206655

[51] Int. Cl.[4] ..... E02D 27/48

[52] U.S. Cl. ..... 405/233; 405/230

[58] Field of Search ..... 405/229, 230, 233, 236

[56] References Cited

U.S. PATENT DOCUMENTS 2,923,133 2/1960 Muller ..... 405/236

FOREIGN PATENT DOCUMENTS 1801984 4/1970 Fed. Rep. of Germany ..... 405/230
2013992 12/1970 Fed. Rep. of Germany ..... 405/230
396556 8/1933 United Kingdom ..... 405/230
985351 3/1965 United Kingdom ..... 405/230

*Primary Examiner*—David H. Corbin

*Attorney, Agent, or Firm*—Richards, Harris, Medlock & Andrews

[57] ABSTRACT

A method of installing a pile beneath the foundations of a building comprises forming a hole, preferably at a small angle to the vertical, through the foundation driving a first pile casing section through said hole into the ground beneath the foundation with a percussive machine located at or near floor or ground level of the building, applying to the end of the first pile casing section a further pile casing section and driving the composite pile casing into the ground by a percussive machine located no lower than the floor or ground level of the building, fitting a further percussive machine having a maximum external diameter no greater than the maximum external diameter of the foundation hole and driving said casing further into the ground with said further percussive machine following the casing into the ground, completing said further driving operation before said further percussive machine penetrates completely below floor or ground level, withdrawing said further percussive machine and thereafter inserting a cementitious mixture under pressure into the composite pile casing and the hole formed by said percussive member and allowing said cementitious material to set.

11 Claims, 1 Drawing Figure

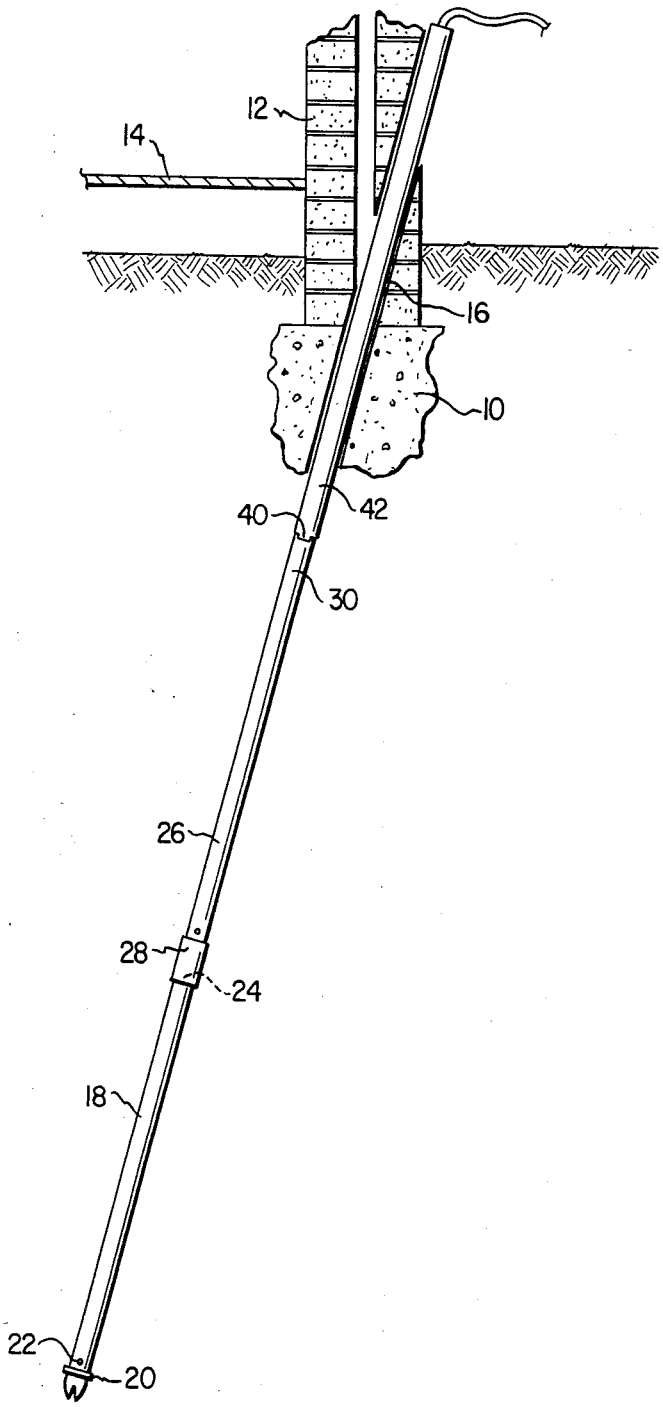
12
14
16
10
40
42
30
26
28
24
18
22
20

PILING METHOD

TECHNICAL FIELD

The present invention concerns an improved piling method, especially but not exclusively a method for providing piles beneath a previously built building which has been unstable.

BACKGROUND ART

Often the building concerned is a dwelling and whereas main use of method is outside it must be realised the apparatus employed and the method of employing the apparatus must be such that it can be utilised also within a dwelling with the minimum of disruption. Thus it is not possible to employ relatively large and heavy pile-driving or drilling apparatus nor is it possible to utilise long pre-formed piles or piles which are as heavy as they required mechanical handling.

In the past several methods have been employed to provide piles beneath the foundations of an existing dwelling but each of these methods suffer from certain drawbacks. It is an object of the present invention to obviate or mitigate these drawbacks.

DISCLOSURE OF THE INVENTION

According to the present invention there is provided a method of installing a pile beneath the foundation of an existing building comprising forming a hole through the foundation by a rotary-percussive method, driving a first pile casing section through said hole into the ground beneath the foundation with a percussive machine located at or near floor or ground level of the building, applying to the end of the first pile casing section a further pile casing section and driving the composite pile casing into the ground by a percussive machine located no lower than the floor or ground level of the building, fitting a further percussive machine having a maximum external diameter no greater than than the maximum external diameter of the foundation hole and driving said casing further into the ground with said further percussive machine following the casing into the ground, completing said further driving operation before said further percussive machine penetrates completely below floor or ground level, withdrawing said further percussive machine and thereafter inserting a cementitious mixture under pressure into the composite pile casing and the hole formed by said percussive member and allowing said cementitious material to set.

Preferably the cementitious mixture is inserted under pressure.

Preferably each pile casing section is provided with radially extending holes such that when the cementitious mixture is grout it may exhaust outwardly from said holes into the surrounding ground.

Preferably the hole through the foundation is formed at an angle to the vertical and preferably is formed also through the wall supported by the foundation such that the hole may be commenced at above floor or ground level without disturbing the floor etc.

Preferably the hole is formed by a rotary percussive tool having an external diameter slightly greater than the maximum external diameter of the pile casing sections.

Preferably the rotary percussive drill has a pneumatic percussive action and a hydraulic rotary action. Further, the speed of feed of the drill is very closely controlled by hydraulic/mechanical means.

Alternatively a diamond bit rotary drilling technique may be used, especially where the foundation includes a reinforcement. This diamond drilling technique is preferably used in addition to the much more economic percussive technique.

Preferably the pile member casing sections are interconnected in a spigot and socket manner.

Preferably the socket is formed on the lower end of the second and subsequent casing sections by welding a collar to the said lower end of said section. Preferably said grout holes are provided adjacent said collar whereby on penetrating the ground the collar forms a void behind it thereby preventing blockage of the holes.

Preferably the lower end of the first pile member casing section is deformed into a point.

Preferably the holes towards the pointed end of said first casing section are protected by a circumferential protrusion between the pile point and said holes, said protrusion being formed by a weld bead.

Preferably the grout is supplied to the composite pile casing under pressure by a lance-like arrangement including an inflatable collar around said lance whereby the lance may be inserted into the casing member, the collar inflated to form a seal and grout forced under pressure through the lance into the casing.

According to another aspect of the present invention the method defined in the last paragraph of page 1 is followed in all aspects except that the hole is preformed when the foundation is laid. Obviously this method applies to a new building.

BRIEF DESCRIPTION OF THE DRAWINGS

An embodiment of the present invention will now be described by way of example only with reference to the accompanying drawing which shows diagrammatically a foundation with a pile installed thereunder.

DETAILED DESCRIPTION

A foundation or footing 10 of concrete supports a wall 12 of a building having a floor 14.

The first stage in the pile installation method is the drilling of 103 mm outside diameter hole through the footing 10 and such that this can be carried out with minimum disruption it is desirable that the hole is started above ground level. Utilising a standard rotary percussive 103 mm diameter drilling bit in a pneumatic percussive drill the hole is bored at an angle to the vertical, as shown in the drawing, such that it passes through the wall and through the footing. The percussive drill is rigidly mounted in a portable holding apparatus to which supplies of high pressure air and high pressure pneumatic fluid are connected. The high pressure air is utilised to drive the percussive hammer which is rotated by hydraulic means. It has been found that standard pneumatic rotary percussive drilling arrangements which are capable of providing sufficient torque are unsatisfactory in that they are too large for utilisation in the circumstances normally encountered in dwellings. The framework of the machine, however, carries an arrangement for imparting torque to the drilling bit of a smaller percussive drill which utilises all the pneumatic power available and it has been discovered that this gives a satisfactory drilling result. It has been discovered also that by very finely controlling the speed of feed, again by suitable hydraulic means, especially during the initial drilling operation, the hole can be drilled very close to the vertical through the wall. Normally at the start of such drilling operation it has been found that the drill bit skids off the wall but, as stated above, by closely controlling and slowly feeding the rotating percussive drill this relatively crude but a highly economical drilling method can be employed to give most satisfactory results. These results are far superior to those obtained by a rotary diamond drilling technique as the drilling speeds obtainable are much higher and the tool life expectancy is much greater, the rotary percussive bit being much less expensive than the diamond bit.

In certain circumstances it is required to utilise a diamond bit, for example where reinforcing steel is included in the the footing. With the present technique the rotary percussive drill is utilised to drill through the brickwork and the footing until the steel is reached and a smaller diameter diamond drill is then utilised to cut through any reinforcement. It has been found advantageous that the rotary percussive drill is provided with back reaming facilities to aid its removal from the hole once it has been drilled.

When the hole 16 has been drilled through the wall and footing a first pile casing section 18, which is manufactured from approximately 2 mm thick mild steel, is approximately two meter length and has a diameter 90 mm, 13 mm less than the maximum external diameter of the hole, is placed by hand in the hole. It is then driven downwards into the ground beneath the footing by a pneumatic percussive hammer having a fitment on its end to neatly accommodate the upper end 24 of the pile section 18. The lower end of the pile section 18 is provided with four radially extending folds such that it is formed into a point. Adjacent this point there is provided a circumferential weld bead 20 providing a protrusion and in the region of the weld bead 20 three equi-spaced holes 22 are formed through the casing section. When the pile section 18 is driven such that is upper end 24 is at or approximately at ground level a second pile casing section 26 is fitted thereto, this second section having an oversized diameter sleeve 28 welded to its lower end such that the upper end 24 of the first section is accommodated therein. The same relatively low powered percussive hammer is fitted to the top 30 of the second section 26 and on continued operation of said hammer the composite casing 18, 26 is driven further into the ground until the upper end 30 of the second section is at approximately ground level.

At this stage a second percussive hammer mechanism is employed. This mechanism, commonly known as a torpedo or mole, comprises a steel cylinder (95 mm diameter) in which a percussive piston is fitted, movement of the piston causing the torpedo to progress in the direction of one of its ends. This end 40 of the torpedo 42 is inserted into the upper end 30 of the second casing section and operation of the torpedo 42 causes the casing sections, together with the torpedo, to be driven further into the ground. Driving is stopped before the upper end of the torpedo passes ground level such that the torpedo may be readily withdrawn by its upper end.

At this stage a grouting lance comprising a pipe for feeding grout and having an inflatable collar arranged round the pipe is fitted into the upper casing section and the collar is inflated by compressed air to provide a seal with the wall or footing. Grout under pressure is then supplied through the pipe into the hole and casing interior and it will be realised that the grout will exhaust from the holes 22 in the first and second casing sections. As the casing sections have at their lower ends a protrusion, that is in the case of the first casing the weld bead 20 and in the second the sleeve 28, there will be a void around the casing and this will be filled with pressurised grout. Additionally the grout will escape in a substantially radial direction into any fissures in the ground and this will much enhance the "grip" of the pile with the ground.

One or more steel reinforcing rods may be inserted into the grout before it sets or before it is supplied to the casing.

Various modifications can be made without departing from the scope of the invention, for example a torpedo can be utilised for both the initial and secondary driving operations, in the first instance the torpedo being located within the lower section.

To give added stability the piles along a wall of a building can be alternately arranged at the same angle on either side of the vertical. Thus a first pile system is provided as described above with reference to the drawing and then, spaced therefrom along the wall to be supported, a further pile system is provided from the inside of the building at an angle to the vertical, substantially equal but opposite to the angle of the preceding pile system. This arrangement is continued along the wall.

It will be realised that the method and apparatus described in the present specification can be utilised to provide piles not only for foundations but also for slabs on which buildings are supported. Workshops and factories are often built on a slab, the slab carrying machinery etc. If an existing slab is found to be sagging then it can be piled utilising the method described above. Clearly, the piles can be driven in a vertical direction if required.

Thus the term "foundation" when used herein is intended not only to cover footings for walls but also slabs.

It will be realised further that the method of forming the pile can be employed equally well in the construction of a new building. Here the method described above can be employed, that is immediately after the foundations have set they can be drilled and the piles inserted as described above. Alternatively, provision can be made for the piles while the foundations are being laid, for example a sleeve can be cast into the foundation to form the hole therethrough for subsequent accommodation of the pile member. It will be realised after reading the preceding paragraph that when a slab is being cast in the construction of a factory or workshop if it is desired to pile the slab then when it is being cast sleeves can be cast therein to provide the holes for piles to be inserted according to the method described above.

Whilst endeavouring in the foregoing specification to draw attention to those features of the invention believed to be of particular importance it should be understood that the Applicant claims protection in respect of any patentable feature or combination of features hereinbefore referred to whether or not particular emphasis has been placed thereon.

I claim:

1. A method of providing a pile for a building comprising forming a passage through a foundation as it is being formed, driving a first pile casing section through said passage into the ground beneath the foundation with a percussive machine located at or near floor or ground level of the building, applying to the end of the first pile casing section a further pile casing section and driving the composite pile casing into the ground by a percussive machine located no lower than the floor or ground level of the building, fitting a percussive machine having a maximum external diameter no greater than the maximum external diameter of the foundation passage and driving said casing further into the ground with said further percussive machine following the casing into the ground, completing said further driving operation before said percussive machine penetrates completely below floor or ground level, withdrawing said percussive machine and thereafter inserting a cementitious mixture under pressure into the composite pile casing and the hole formed by said percussive member and allowing said cementitious material to set.

2. A method as claimed in claim 1, in which the cementitious mixture is inserted under pressure and in which each pile casing section is provided with radially extending holes such that when the cementitious mixture is inserted it may exhaust outwardly from said holes into the surrounding ground.

3. A method as claimed in claim 1 or claim 2, in which the hole through the foundation is formed at an angle to the vertical and is formed also through the wall supported by the foundation such that the hole may be commenced at above floor or ground level without disturbing the floor etc.

4. A method as claimed in claim 1, in which the pile member casing sections are interconnected in a spigot and socket manner with the socket formed on the lower end of the second and subsequent casing sections by welding a collar to the said lower end of said section and with said grout holes located adjacent said collar whereby on penetrating the ground the collar forms a void behind it thereby preventing blockage of the holes.

5. A method as claimed in claim 1, in which the lower end of the first pile member casing section is deformed into a point and holes adjacent the pointed end of said first casing section are protected by a circumferential protrusion between the pile point and said holes, said protrusion being formed by a weld bead.

6. A method of installing a pile beneath the foundation of an existing building comprising forming a hole through the foundation by a rotary-percussive method, driving a first pile casing section through said hole into the ground beneath the foundation with a percussive machine located at or near floor or ground level of the building, applying to the end of the first pile casing section of a further pile casing section and driving the composite pile casing into the ground by a percussive machine located no lower than the floor or ground level of the building, fitting a percussive machine having a maximum external diameter no greater than the maximum external diameter of the foundation hole and driving said casing further into the ground with said percussive machine following the casing into the ground, completing said further driving operation before said percussive machine penetrates completely below floor or ground level, withdrawing said percussive machine and thereafter inserting a cementitious mixuture under pressure into the composite pile casing and the hole formed by said percussive member and allowing said cementitious material to set.

7. A method as claimed in claim 6, in which the cementitious mixture is inserted under pressure and in which each pile casing section is provided with radially extending holes such that when the cementitious mixture is inserted it may exhaust outwardly from said holes into the surrounding ground.

8. A method as claimed in claim 6 or claim 7, in which the hole through the foundation is formed at an angle to the vertical and is formed also through the wall supported by the foundation such that the hole may be commenced at above floor or ground level without disturbing the floor etc.

9. A method as claimed in claim 6, in which the rotary percussive drill has a pneumatic percussive action and a hydraulic rotary action, the speed of feed of the drill being very closely controlled by hydraulic/mechanical means.

10. A method as claimed in claim 6, in which the pile member casing sections are interconnected in a spigot and socket manner with the socket formed on the lower end of the second and subsequent casing sections by welding a collar to the said lower end of said section and with said grout holes located adjacent said collar whereby on penetrating the ground the collar forms a void behind it thereby preventing blockage of the holes.

11. A method as claimed in claim 6, in which the lower end of the first pile member casing section is deformed into a point and holes adjacent the pointed end of said first casing section are protected by a circumferential protrusion between the pile point and said holes, said protrusion being formed by a weld bead.

* * * * *